United States Patent [19]

Le Gars

[11] Patent Number: 5,023,763

[45] Date of Patent: Jun. 11, 1991

[54] ILLUMINATED DISPLAY PANEL

[75] Inventor: Monsieur J. Le Gars, Maurepas, France

[73] Assignee: Societe d'Etudes pour le Developpement des Productions Electroniques, Maurepas, France

[21] Appl. No.: 424,549

[22] Filed: Oct. 20, 1989

[30] Foreign Application Priority Data

Oct. 21, 1988 [FR] France ..... 88 13869

[51] Int. Cl.[5] ..... F21V 9/00

[52] U.S. Cl. ..... 362/240; 362/293; 362/800

[58] Field of Search ..... 362/235, 237, 293, 342, 362/800, 812, 331, 240

[56] References Cited

U.S. PATENT DOCUMENTS 3,631,461 12/1971 Powell et al. ..... 340/339
4,218,603 8/1980 Satoh ..... 362/812 X
4,306,716 12/1981 James et al. ..... 362/800 X
4,530,041 7/1985 Yamai et al. ..... 362/293 X
4,656,567 4/1987 Morris ..... 362/293 X

FOREIGN PATENT DOCUMENTS 2422853 3/1975 Fed. Rep. of Germany .
2542095 3/1977 Fed. Rep. of Germany .
1440274 6/1976 United Kingdom .

*Primary Examiner*—Stephen F. Husar
*Assistant Examiner*—Peggy A. Neils
*Attorney, Agent, or Firm*—Bachman & LaPointe

[57] ABSTRACT

A display device comprises luminous elements such as individual or grouped light-emitting diodes or the like emitting light of a particular color. Spaced outlet windows for these luminous elements are provided in a surface the whole of which is covered by a first filter the same color as the light emitted by the luminous elements. A second filter the complementary color to the first filter covers the spaces on this surface between the windows.

7 Claims, 2 Drawing Sheets

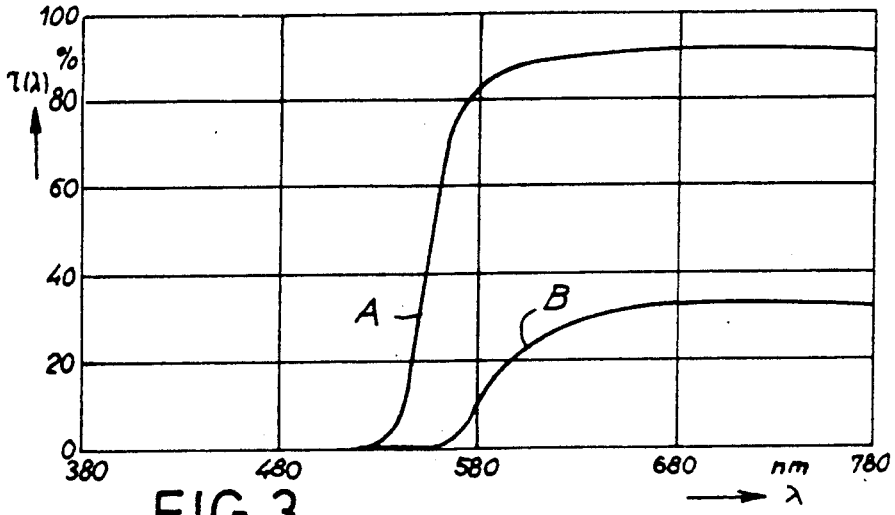
FIG.3
FIG.4
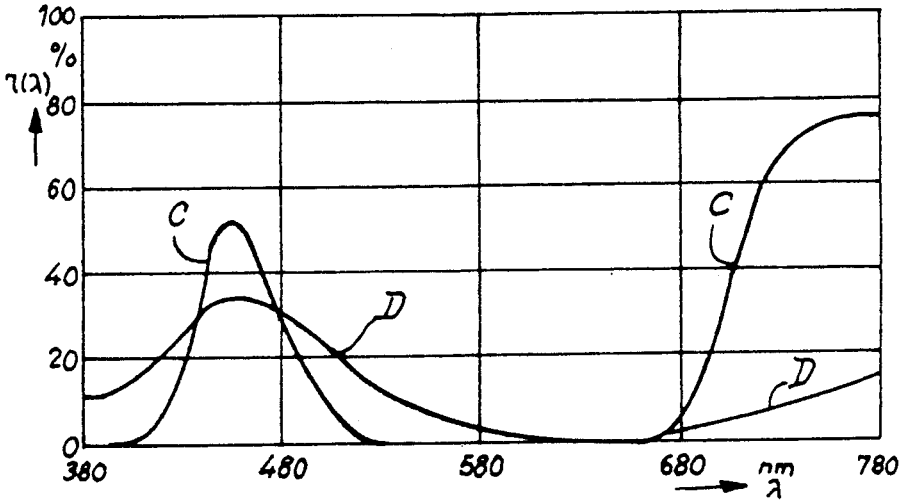
FIG.5
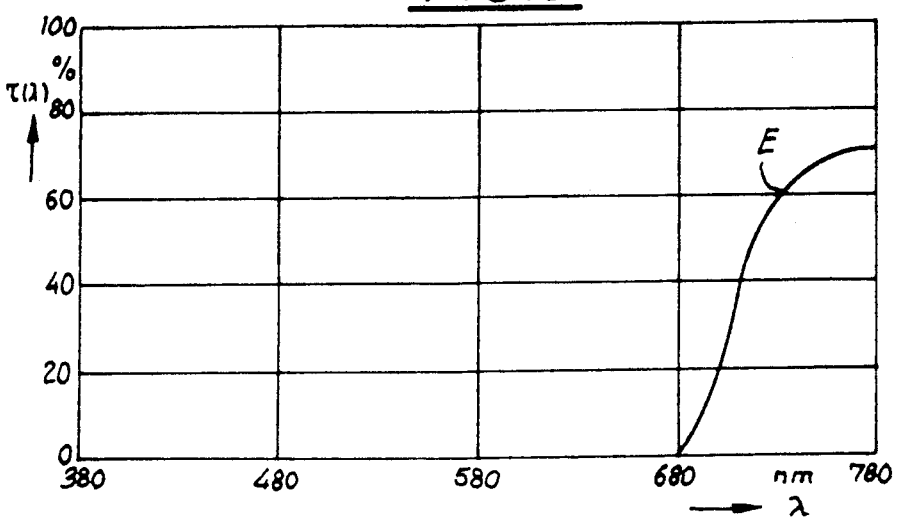

ILLUMINATED DISPLAY PANEL

BACKGROUND OF THE INVENTION

1. Field of the Invention

The present invention concerns display panels using luminous elements such as light-emitting diodes, for example.

2. Description of the Prior Art

A serious disadvantage of known display panels is their poor visibility under high illumination, for example during very sunny weather in the case of outdoor panels.

In this situation it is common for the illumination due to the sun to be as high at 10 000 to 50 000 lux, that is to say 1 to 5 lumens per square centimeter.

One should consider the example of a display panel having a mosaic structure made up of matrices or bars of light-emitting diodes each adapted to deliver a few tens of millilumens through windows having a surface area in the order of one square centimeter, surrounded by a background in front of which is disposed, slightly forward of the light-emitting diodes, a perforated mask through the holes in which the light emitted by the light-emitting diodes passes, and which is required to be totally black. In this example, it is found that the illumination of the luminous areas corresponding to the holes in the mask and due to the luminescence of the diodes (and therefore amounting to a few tens of millilumens per square centimeter) is not preponderant as compared with the ambient illumination (30 to 200 millilumens on the black areas, since it is difficult to reduce reflections here to less than 3 or 4%).

The conventional way to minimize this disadvantage is to place in front of the perforated mask (on the observer side) a filter which generally comprises a plate of synthetic material the same color as is emitted by the luminous elements; most of the light emitted by the luminous elements is therefore transmitted to the observer whereas only the component of the ambient light which corresponds to the color of the filter is transmitted to the display surface, which reduces the illumination due to ambient light. The light-emitting diodes that are tending increasingly to be used emit in the yellow-orange band. The human eye is highly sensitive to the yellow-orange band, so that the display is as legible as possible in the usual cases. The yellow-orange band is particularly strong in solar radiation, however, which means that in this band the filter (which is also yellow-orange) is relatively ineffective and cannot in practice significantly enhance the legibility of the panel.

Another conventional way to attempt to increase legibility is to increase the power of the light-emitting diodes, or the other luminous elements used.

However, this approach comes up against technological obstacles that are increasingly difficult to overcome.

An object of the invention is to remedy this disadvantage.

SUMMARY OF THE INVENTION

The present invention consists in a display device comprising luminous elements such as individual or grouped light-emitting diodes or the like emitting light of a particular color, a surface having spaced outlet windows for said luminous elements, a first filter the same color as the light emitted by said luminous elements covering the whole of said surface and a second filter the complementary color to said first filter covering the spaces on said surface between said windows.

The complementary color filter disposed in front of the spaces between the luminous elements, possibly replacing the usual perforated mask, considerably enhances the legibility of the panel.

Other characteristics and advantages of the invention will emerge from the following description of one preferred embodiment of the invention given by way of non-limiting example and with reference to the appended diagrammatic drawings.

BRIEF DESCRIPTION OF THE DRAWINGS

FIG. 3 shows a curve of transmission plotted as a function of wavelength for orange filters used in known panels.

FIG. 4 shows a curve of transmission plotted as a function of wavelength for filters the complementary color to that of the filters from FIG. 3.

FIG. 5 shows the transmission curve corresponding to the conjoint use of a filter from FIG. 3 and a filter from FIG. 4.

DETAILED DESCRIPTION OF THE INVENTION

Figure 1:
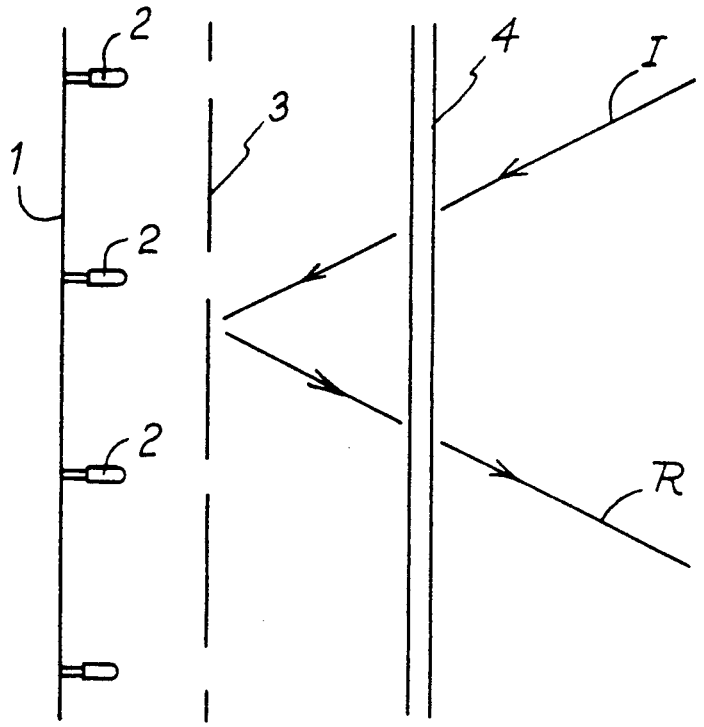
FIG. 1 shows the structure of a known panel.

The display panel shown in FIG. 1 comprises a printed circuit board 1 on which are mounted luminous elements 2, in this instance light-emitting diodes, distributed with a particular spacing. The range of wavelengths that the light-emitting diodes emit is in this instance in the orange band. In front of the printed circuit board 1 is a perforated mask 3 the holes in which are aligned with the light-emitting diodes; thus over all of the surface over which the outlet windows of the luminous elements are disposed the mask masks the spaces between the diodes, and only these spaces, from incident ambient light rays I. A filter 4 the same color as the light emitted by the diodes, and generally given an anti-reflection treatment, is also disposed in front of the whole of the printed circuit board; thus in theory all components of the ambient light except in this instance the orange component are eliminated from the space between the filter and the mask.

The transmission curve of such filters (which in fact tend towards orange-red in this instance) as a function of the wavelength is shown in FIG. 3. Note that a good filter (here denoted A) transmits more than 80% of the light at the wavelength 580 nm although it transmits less than 5% of the light at 530 nm, the other filter (here denoted B) being less effective; in the present instance these filters are close to their maximum transmission over all the visible band from yellow for the better performance filter and from orange for the other filter.

With the first filter A approximately 80% of the orange light at 580 nm emitted by the diode is therefore transmitted to the observer whereas, the reflection coefficient of the mask being 3 to 4%, the mask returns 2.4 to 3.2% of the ambient orange light and the ray reflected to the observer comprises approximately 1.9 to 2.6% of this light (reflected ray R).

Figure 2:
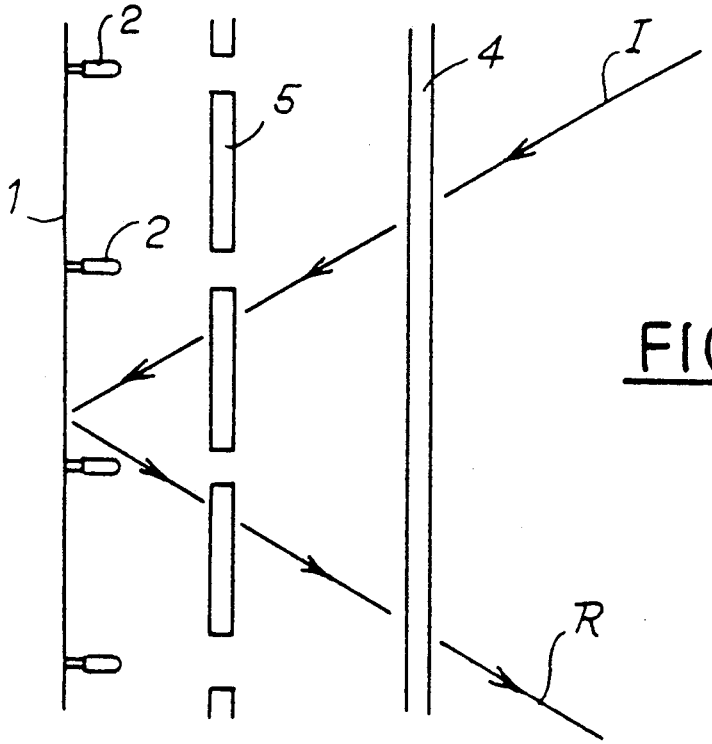
FIG. 2 shows the structure of a panel in accordance with the invention.

In accordance with the invention (FIG. 2) there is placed in front of the printed circuit board 1 a perforated filter 5 which is the complementary color to the filter 4 and the holes in which are aligned with the light-emitting diodes 2 (the same components carry the same reference numbers in FIGS. 1 and 2); thus over all of the surface over which the outlet windows of the luminous elements are arranged the complementary color filter 5 (in this instance a blue filter) masks the spaces between the diodes but allows the light rays from the diodes to pass freely. As will be understood from the explanation to be given later, this filter is much more effective than a mask as its coefficient of reflection is very low and its coefficient of transmission is also very low.

The transmission curve of blue filters of this kind is shown in FIG. 4. Note that at wavelengths corresponding to yellow, and over a broad band beyond these, the transmission of these filters is very low. For example, a first filter (denoted C) has a transmission "peak" in the blue (around 450 nm) and a transmission coefficient that is very low from 530 nm to 680 nm, the transmission coefficient then increasing up to a wavelength of around 750 nm (red approaching the red limit and the infra-red band). Another filter (denoted D) has a transmission peak in the blue that is rather less pronounced, with a wider "foot", but the band of very low transmission is much narrower; on the other hand, its transmission remains low in the red and infra-red bands. Consideration might therefore be given to using this latter filter in combination with an orange filter as its transmission is almost always low or even very low.

However, the blue filter C is actually more appropriate as its transmission is very low precisely in that area where the orange filter A (which allows virtually all the light from the diodes to pass) is "transparent", except from 680 nm.

The result of the conjugation of the two filters A and C in the space between the diodes (spurious reflections from which can easily be maintained at a very low level, possibly by means of an anti-reflection treatment) is that the transmission of ambient light (incident ray I) at the level of the printed circuit is already lower than the transmission at the level of the mask in conventional panels (reduced by a factor of more than 10 below 430 nm and above 500 nm up to 680 nm, and reduced by a factor of only 2 around 450 nm, with an intermediate area from 430 nm to 450 nm and from 450 nm to 500 nm), although this cannot be shown on the resultant curve in FIG. 5 because of the scale.

If these results are compared with those achieved by means of a black mask the difference might nevertheless seem insignificant.

However, it is not in fact the quantity of ambient light that reaches the space between the diodes which is important, but rather that which returns to the retina of the observer after passing twice through the system of filters, once in the incident direction and a second time in the return direction (reflected ray R).

The attenuation due to the system of filters is the square of the attenuation previously mentioned: assuming 100% reflection at the printed circuit the light reaching the observer is consequently reduced by a factor of more than 100 below 430 nm and above 500 nm up to 680 nm and reduced by a factor of only 4 around 450 nm, with an intermediate area from 430 nm to 450 nm and from 450 nm to 500 nm; it is simple to achieve (by means of an appropriate coating) a coefficient of reflection at the printed circuit that is in the order of 20%, and the reduction factors are then respectively increased to more than 500 below 430 nm and above 500 nm up to 680 nm and to 20 around 450 nm, which is highly advantageous as compared with the case where the light merely passes twice through an orange filter, respectively before and after reflection at a black mask reflecting only 3 to 4% of the incident light.

To summarise, the replacement of the black mask by the filter which is the complementary color to the color emitted by the diodes corresponds to replacing the coefficient of reflection of the mask with the square of the coefficient of transmission of the complementary color filter multiplied by the coefficient of reflection of the printed circuit board, ignoring spurious reflections from the front surface of the filter.

What is more, the very small transmission peak (it is actually invisible in FIG. 5) of the complementary filter around 450 nm is not a problem because it is very narrow and so does not correspond to any significant illumination and because it is in the blue, the color complementary to the color emitted by the diodes. The fact that the attenuation is not very high beyond 680 nm is also of little importance because the solar spectrum contains very little light in this range during daylight hours.

In any event, the considerable improvement indicated by the theory is actually observed in practice.

The material of the filters is a synthetic material marketed under the tradename "PLEXIGLASS", the orange-red filters having the respective references 478g01 (A), 466g33 (B) and the blue filters the references 627g01 (C) and 648g01 (D).

It is naturally possible to improve the result further by inserting the additional filter between the mask and the filter the same color as is emitted by the diodes, rather than substituting the additional filter for the mask.

Of course, the invention is not limited to the embodiment described above and shown and other embodiments could be arrived at without departing from the scope of the invention, in particular through the use of colors other than orange and the use of luminous elements other than light-emitting diodes, for example discharge tubes such as neon tubes or tubes marketed under the tradename "NIXIE"; note also that although the example described uses luminous elements in the form of individual light-emitting diodes, the luminous elements in front of each of which the complementary color filter comprises an opening could be groups of diodes (or discharge tubes or the like), possibly of different colors which are intended to mix (green diodes and red diodes, for example).

What is claimed is:

1. Display device comprising: spaced luminous elements of light-emitting diodes each having an outlet window by which light of a particular color is emitted, said outlet windows defining a plane portion on which the windows are distributed with spaced portions between the windows; a first filter having the same color as the light emitted by said luminous elements and covering the whole of said plane portion; and a second filter having a complementary color to said first filter covering only the spaced portions between the windows, whereby the second filter masks the spaced portions but permits light rays from the luminous elements to pass freely.

2. Display device according to claim 1 wherein said complementary color filter is a perforated plate the holes in which are aligned with said luminous elements.

3. Display device according to claim 1 wherein at least one of said first and second filters has received an anti-reflection treatment.

4. Display device according to claim 1 further comprising, on the side of said second filter opposite said first filter, a preforated mask the perforations in which are aligned with said windows.

5. Display device according to claim 1 further comprising a board with an anti-reflective coating on which said luminous elements are mounted.

6. Display device according to claim 1 wherein said luminous elements emit light in the range of wavelengths corresponding to the color orange.

7. Display device according to claim 1 wherein said second filter is a blue filter.

* * * * *